United States Patent [19]

Dahlgren

[11] Patent Number: 5,067,065

[45] Date of Patent: Nov. 19, 1991

[54] SHOCK ABSORBENT BULBHOLDER MOUNTING

[75] Inventor: Douglas L. Dahlgren, Holdrege, Nebr.

[73] Assignee: Allmand Bros. Inc., Holdrege, Nebr.

[21] Appl. No.: 607,420

[22] Filed: Oct. 31, 1990

[51] Int. Cl.[5] ..... F21V 15/04

[52] U.S. Cl. ..... 362/369; 362/390; 248/624

[58] Field of Search ..... 362/390, 369, 249, 431, 362/427; 248/603, 624; 267/166, 248, 254, 260

[56] References Cited

U.S. PATENT DOCUMENTS

| | | | |
|---|---|---|---|
| 241,112 | 5/1881 | Woolley | 362/390 |
| 391,808 | 10/1888 | Madden | 362/390 |
| 1,435,763 | 11/1922 | Townsend | 248/603 |
| 1,536,407 | 5/1925 | Pettus | 362/369 |
| 1,643,925 | 9/1927 | Cooke, Jr. | 362/369 |
| 3,749,907 | 7/1973 | Allmand | 240/52 R |
| 4,482,125 | 11/1984 | Ziernicki | 362/369 |
| 4,870,552 | 9/1989 | Vitta et al. | 362/390 |

FOREIGN PATENT DOCUMENTS

| | | | |
|---|---|---|---|
| 461683 | 1/1914 | France | 362/390 |

*Primary Examiner*—Ira S. Lazarus
*Assistant Examiner*—Richard R. Cole
*Attorney, Agent, or Firm*—Henderson & Sturm

[57] ABSTRACT

A shock absorbent bulbholder mounting assembly including a yoke support and a bulbholder interconnected by a pair of spring mounted subassemblies. Each of the subassemblies includes an elongated arm strap adjustably attached to rotate with respect to a respective arm section of the yoke support, and an elongated bulbholder strap attached to a respective side member extending from opposing sides of the bulbholder. The arm strap and the bulbholder strap are disposed in spaced parallel planes. The longitudinal axes of the straps are oriented at right angles to one another, and each end of each strap is connected by two springs to opposite ends of the other strap. Four springs thus span the gap between the straps and each spring is oriented at a 45° angle with respect to the longitudinal axes of the straps.

3 Claims, 3 Drawing Sheets

SHOCK ABSORBENT BULBHOLDER MOUNTING

TECHNICAL FIELD

This invention relates generally to bulbholder support devices and more particularly to a bulbholder mounting assembly in which the bulbholder and the lamp contained therein are protected from vibration and shock damage.

BACKGROUND ART

When larger wattage lamps and their bulbholders are mounted in a conventional rigid fashion on a light pole, frequently they become damaged by vibration and shock conditions to which they are subjected, especially in heavily industrialized areas. While the bulbholder must be adequately supported in a stable condition from a light pole, nevertheless it is desirable that the bulbholder have some degree of resiliency sufficient to protect the lamp from vibration and shock damage.

In addition, it is highly beneficial and desirable to have a lamp which may be adjusted either upwardly or downwardly so that the light emitted from the lamp may be projected or aimed as desired. The invention disclosed in U.S. Pat. No. 3,749,907provides the total combination of these advantages, however, the structure and the mounting assembly are unduly complicated. Also, the springs are positioned in parallel pairs so that they provide more resistance in one direction than the other which results in non-uniform absorption of the shock.

Those concerned with these and other problems recognize the need for an improved shock absorbent bulbholder mounting assembly.

DISCLOSURE OF THE INVENTION

The present invention provides a shock absorbent bulbholder mounting assembly including a yoke support and a bulbholder interconnected by a pair of spring mounted subassemblies. Each of the subassemblies includes an elongated arm strap adjustably attached to rotate with respect to a respective arm section of the yoke support, and an elongated bulbholder strap attached to a respective side member extending from opposing sides of the bulbholder. The arm strap and the bulbholder strap are disposed in spaced parallel planes. The longitudinal axes of the straps are oriented at right angles to one another, and each end of each strap is connected by two springs to opposite ends of the other strap. Four springs thus span the gap between the straps and each spring is oriented at a 45° angle with respect to the longitudinal axes of the straps.

Accordingly, the primary object of this invention resides in the provision of a novel, bulbholder mounting assembly having an uncomplicated structure which provides a stable support for a lamp and its bulbholder and minimizes the amount of vibration and shock to which the lamp is subjected.

Another object of the invention resides in the provision of a novel bulbholder mounting assembly formed by a main C-shaped yoke support member having spaced end arms and a pair of spring mounted subassemblies supporting opposite ends of a bulbholder between the end arms of the yoke member. The spring assemblies provide a resilient support connection between the bulbholder and the yoke member and thereby protect the lamp itself from vibration and shock damage which might be caused by forces applied to the main yoke member and the light pole on which it may be supported. A further object of the invention resides in the provision of a novel bulbholder mounting assembly as discussed in the previous objects, wherein each of the spring support subassemblies is adjustable relative to the yoke member so that the bulbholder may be adjusted through substantially 360° and the light from the lamp may be aimed or projected upwardly or downwardly as desired.

Another object is to provide a bulbholder mounting assembly that is durable and easy to maintain.

A further object of the invention is the provision of a bulbholder mounting assembly that is simple in structure and inexpensive to manufacture.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
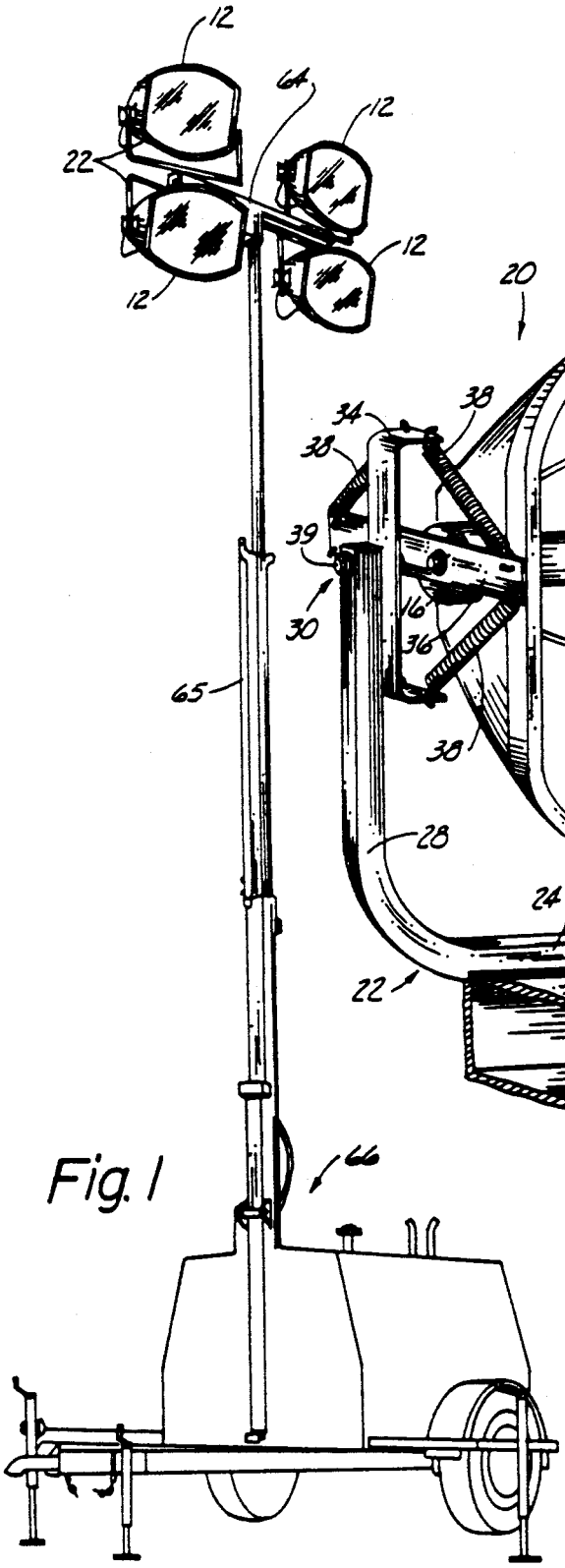
FIG. 1 is a perspective view showing an array of bulbholders supported above a portable light plant by the mounting assembly of the present invention.
Figure 2:
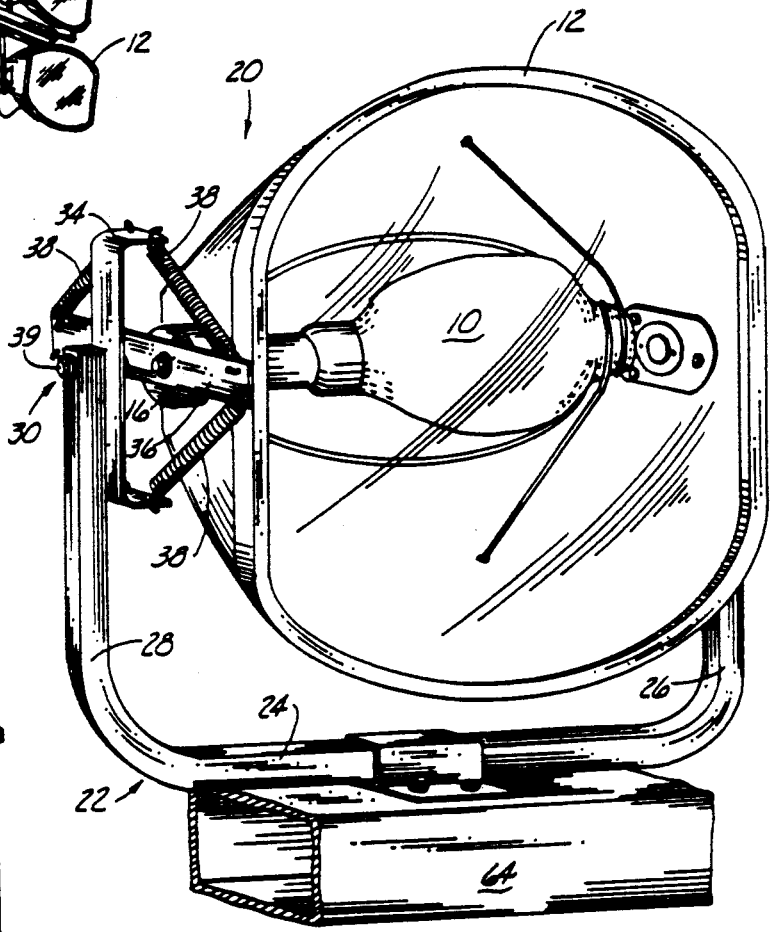
FIG. 2 is an enlarged partial perspective view of a single bulbholder supported on a T-bar.
Figure 3:
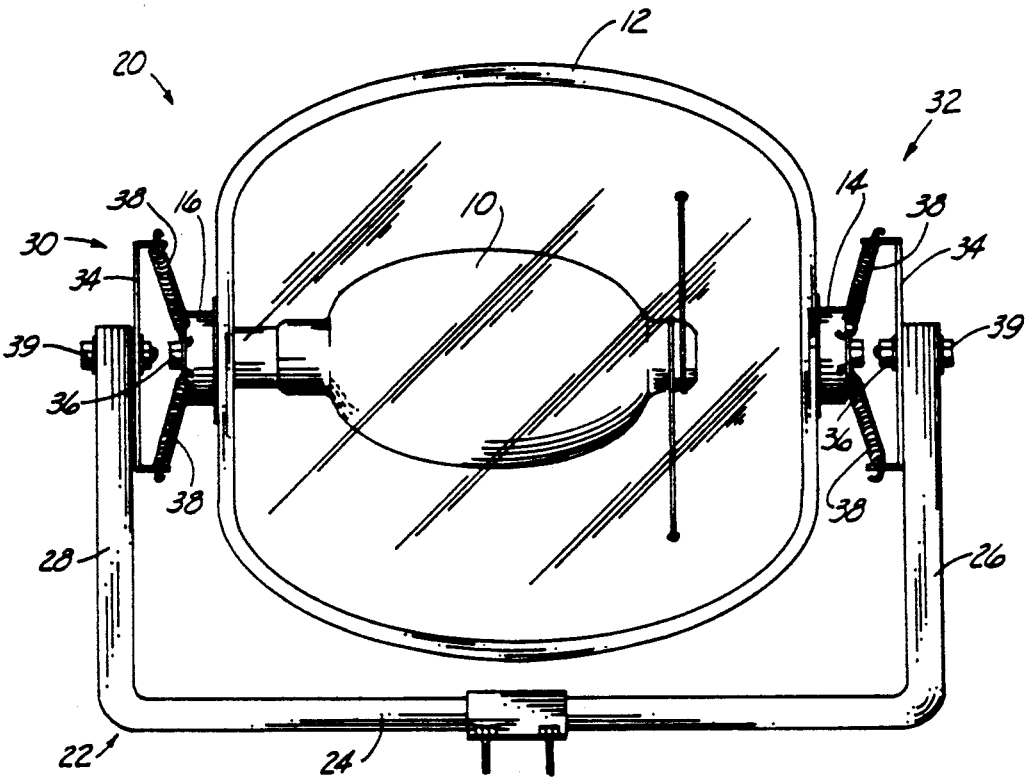
FIG. 3 is a front elevational view of the mounting assembly.
Figure 4:
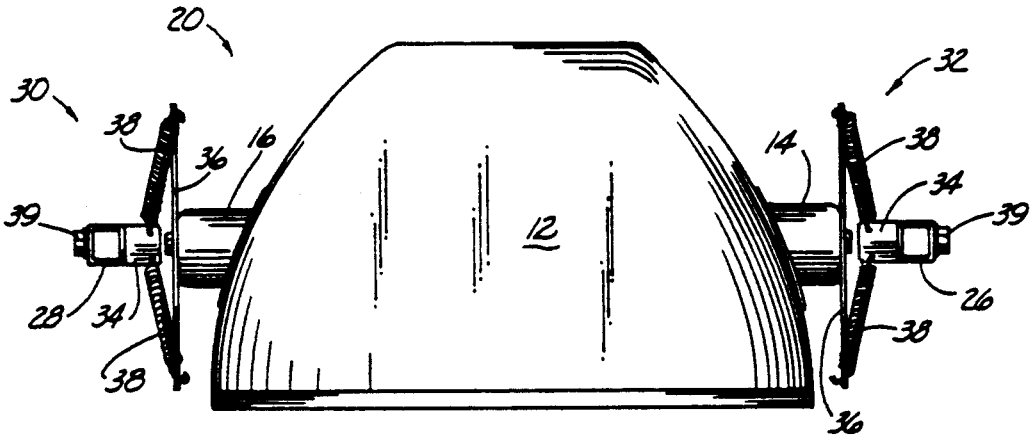
FIG. 4 is a top plan view thereof.
Figure 6:
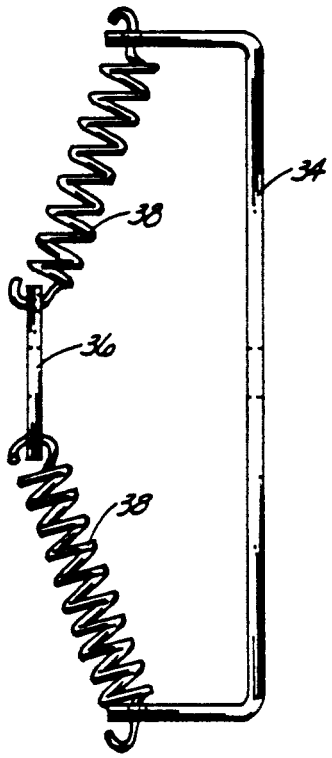
FIG. 6 is a front elevational view of the spring assembly.
Figure 5:
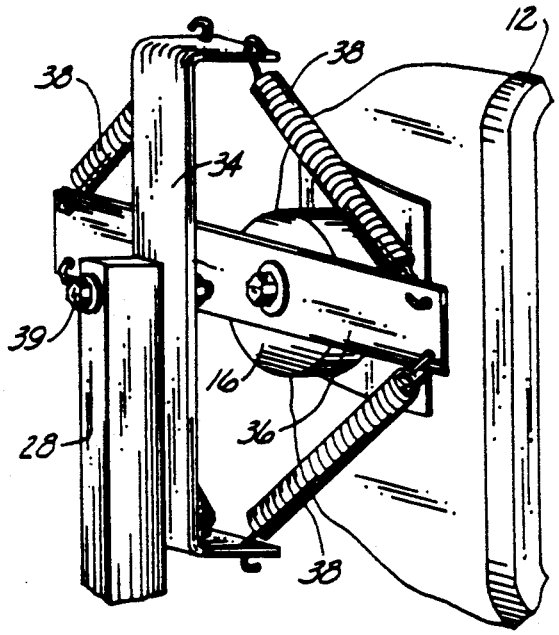
FIG. 5 is a greatly enlarged partial perspective view showing the spring assembly.

Referring now to the drawings, wherein like reference numerals designate identical or corresponding parts throughout the several views, FIG. 1 shows a lamp (10), such as a 1,000 watt multi-vapor lamp mounted in conventional fashion within a commercially available bulbholder (12) having opposed side extensions (14, 16), one of which, e.g., extension (16), is formed as a conventional electrical socket to receive the socket end of the lamp (10) in conventional fashion. The array of the bulbholders (12) are supported in suitable fashion, such as, for example, from a T-bar (64) attached to a vertically extended mast (65) of a portable light plant (66). The bulbholders (12) are supported by a mounting assembly (20) which constitutes the subject matter of this invention.

The mounting assembly (20) is formed by a main C-shaped, square tubular yoke support member (22) having a central base section (24) and a pair of end arm sections (26, 28) which extend substantially perpendicularly from center section (24). A pair of spring support subassemblies (30, 32) resiliently support the bulbholder (12) between the yoke arms (26, 28). One spring subassembly (30) extends between the bulbholder side extension (16) and yoke arm (28); and the other spring subassembly (32) extends between bulbholder projection (14) ad yoke arm (26). Each of the spring support assemblies (30, 32) are identical in construction and, for purposes of brevity, only spring subassembly (30) will be described.

Figure 7:
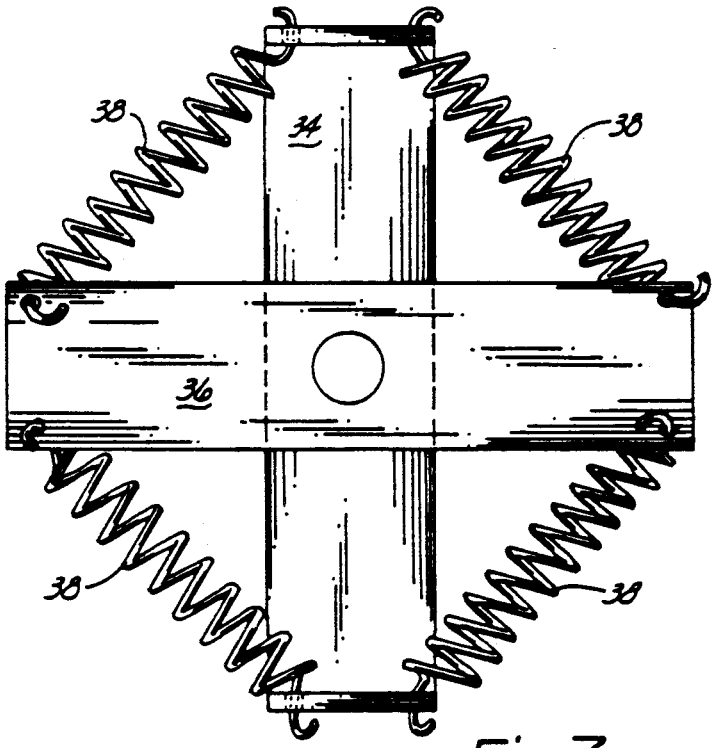
FIG. 7 is a side elevational view thereof.

The spring assembly (30) includes an elongated arm strap (34) adjustably attached to rotate with respect to the arm section (28), and an elongated bulbholder strap (36) attached to extension (16). The arm strap (34) and the bulbholder strap (36) are positioned in spaced parallel planes and the longitudinal axes of the straps (34, 36) are positioned at right angles to one another. Each end of each strap (34, 36) is connected by two springs (38) to opposite ends of the other strap (36, 34), such that the springs (38) span the gap between the straps (34, 36). Thus, a total of four springs (38) interconnect the straps (34, 36) and each of the springs (38) is oriented at a 45° angle with respect to the longitudinal axes of the straps (34, 36) as best shown in FIG. 7. The orientation of the springs (38) allows for identical reaction to shock in any direction. This feature is important since the same absorption is maintained regardless of the adjustment or position of the bulbholders (12).

The described preferred embodiment of the invention provides the objects and advantages which were initially set forth above. For example, the C-shaped yoke member (22) is sufficiently rigid to mount the bulbholder (12) and the lamp (10) supported therein in an elevated vertical position on a T-bar (64), while the spring subassemblies (30, 32) provide sufficient resiliency in the system to protect the bulbholder (12) and lamp (10) itself from damage due to shock and/or vibration which may be transmitted to the T-bar (64) light pole and/or the yoke member (22).

In addition, because the plates (34) of the spring assemblies (30, 32) are readily adjustable relative to the yoke arms (26, 28) by loosening bolts (39), the bulbholder (12) is adjustable through essentially 360° so that the light from the lamp (10) may be projected or aimed upwardly or downwardly as desired. Thus, simply by loosening the bolts (39), the plates (34) may be rotated relative to the arms (26, 28), thus causing proper aiming or orientation of the bulbholder (12) and the lamp (10).

The described bulbholder (12) and mounting assembly (20) provides a complete, lightweight floodlight unit having very good light projection qualities and providing maximum protection of the light itself, thereby affording reliable, efficient and long-term service life, and reducing operating costs. The bulbholder (12) and its mounting assembly (20) are well suited for extreme rough service, since the yoke (22) and the resilient spring assemblies (30, 32) effectively shield the lamp (10) itself from the vibration and shock forces.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A bulbholder mounting assembly comprising:

a support member having a center section and a pair of spaced, transverse arm sections extending from said center section; and means resiliently supporting said bulbholder from said support member between said arm sections comprising:

an elongated arm strap attached to a respective arm section;

an elongated bulbholder strap attached to said bulbholder, said arm strap and said bulbholder strap being disposed in spaced parallel planes, said arm strap and said bulbholder strap having longitudinal axes disposed at right angles to one another; and springs connected to said arm strap and said bulbholder strap such that each end of each strap is connected by two springs to opposite ends of the other strap, each spring being oriented at a 45° angle with respect to the longitudinal axes of the straps.

2. The assembly defined in claim 1 wherein said arm strap is adjustable relative to said arm section to permit adjustment of said bulbholder relative to said support member.

3. The assembly defined in claim 2 wherein said support member is formed of square tubular material.

* * * * *